US009048045B2

(12) United States Patent
Henmi

(10) Patent No.: US 9,048,045 B2
(45) Date of Patent: Jun. 2, 2015

(54) POWER SUPPLY CIRCUIT BREAKER

(71) Applicant: Yazaki Corporation, Minato-ku, Tokyo (JP)

(72) Inventor: Fumitoshi Henmi, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 87 days.

(21) Appl. No.: 13/851,246

(22) Filed: Mar. 27, 2013

(65) Prior Publication Data

US 2013/0228429 A1 Sep. 5, 2013

Related U.S. Application Data

(63) Continuation of application No. 13/610,132, filed on Sep. 11, 2012, now abandoned.

(30) Foreign Application Priority Data

Sep. 12, 2011 (JP) ..... 2011-198033

(51) Int. Cl.
*H01R 13/62* (2006.01)
*H01H 21/02* (2006.01)
*H01R 13/629* (2006.01)
(Continued)

(52) U.S. Cl.
CPC ..... *H01H 21/02* (2013.01); *H01R 13/62933* (2013.01); *H01H 9/102* (2013.01); *H01H 31/122* (2013.01)

(58) Field of Classification Search
USPC ..... 439/157, 188, 372
IPC ..... H01R 13/62938,13/62955, 13/62933, H01R 13/7032, 13/639, 23/7005, 2103/00, H01R 24/46
See application file for complete search history.

(56) References Cited

U.S. PATENT DOCUMENTS 6,755,673 B2 * 6/2004 Fukushima et al. ..... 439/157
7,625,225 B2 * 12/2009 Mori et al. ..... 439/157
(Continued)

FOREIGN PATENT DOCUMENTS

CN 1166679 A 12/1997
EP 0790674 A2 8/1997
(Continued)

OTHER PUBLICATIONS

Communication dated Jul. 18, 2014, from the State Intellectual Property Office of The People's Republic of China in counterpart Chinese Application No. 201210336750.7.
(Continued)

*Primary Examiner* — Hien Vu
(74) *Attorney, Agent, or Firm* — Sughrue Mion, PLLC

(57) ABSTRACT

A power supply circuit breaker includes: a first connector housing; a second connector housing; a lever; a main circuit switch which is brought into a breaking state in a first operation position of the lever, and brought into a connecting state in a connector mating operation position and a second operation position of the lever; a signal circuit switch which is brought into a breaking state in the first operation position and the connector mating operation position of the lever, and brought into a connecting state in the second operation position of the lever; a first lock portion for locking the lever in the second operation position; a second lock portion for locking the lever in the connector mating operation position; and an unlocking operation portion capable of being operated to unlock a lock state of the second lock portion.

3 Claims, 15 Drawing Sheets

(51) Int. Cl.
*H01H 9/10* (2006.01)
*H01H 31/12* (2006.01)

(56) References Cited

U.S. PATENT DOCUMENTS

| | | | | |
|---|---|---|---|---|
| 7,872,206 | B2 * | 1/2011 | Matsunaga et al. | 200/335 |
| 2003/0057958 | A1 | 3/2003 | Fukushima et al. | |
| 2008/0185276 | A1 | 8/2008 | Matsunaga et al. | |

FOREIGN PATENT DOCUMENTS

| | | | |
|---|---|---|---|
| EP | 1296341 | A2 | 3/2003 |
| EP | 2639807 | A1 | 9/2013 |
| JP | 2000311576 | A | 11/2000 |
| JP | 2000322983 | A | 11/2000 |
| JP | 2003-100382 | A | 4/2003 |
| JP | 2010-287342 | A | 12/2010 |

OTHER PUBLICATIONS

Communication dated Sep. 17, 2014, issued by the German Patent Office in corresponding German Application No. 10 2012 216 059.0.

Communication dated Mar. 20, 2015 from the German Patent Office in counterpart application No. 10 2012 216 059.0.

* cited by examiner

FIG.14

| | | POSITION OF LEVER 30 | |
|---|---|---|---|
| | | CONNECTOR MATING OPERATION POSITION (FIG. 8) | SECOND OPERATION POSITION (FIG. 11) |
| POSITION OF UNLOCKING OPERATION PORTION 27 | ORDINARY POSITION (FIGS. 8, 11, 13A) | LK1 ; UNLOCKED<br>LK2 ; UNABLE TO UNLOCK | LK1 ; CAN BE UNLOCKED<br>LK2 ; UNABLE TO UNLOCK |
| | MIDDLE DEFORMATION POSITION (FIG. 13B) | LK1 ; UNLOCKED<br>LK2 ; UNABLE TO UNLOCK | LK1 ; UNABLE TO UNLOCK<br>LK2 ; UNABLE TO UNLOCK (CAN BE UNLOCKED) |
| | DEFORMATION POSITION | LK1 ; UNLOCKED<br>LK2 ; CAN BE UNLOCKED | UNLOCK PREVENTING PORTION 38 PREVENTS UNLOCKING OPERATION PORTION 27 FROM DEFORMING TOWARD DEFORMATION POSITION |

POWER SUPPLY CIRCUIT BREAKER

CROSS-REFERENCE TO RELATED PATENT APPLICATION

This application is a Continuation of U.S. application Ser. No. 13/610,132 filed Sep. 11, 2012, which claims priority on Japanese Patent Application No. 2011-198033, filed Sep. 12, 2011. The contents of the prior applications are incorporated by reference in their entirety.

BACKGROUND OF THE INVENTION

1. Field of the Invention

The present invention relates to a power supply circuit breaker for implementing the connecting and disconnecting of a power supply by the mating and separating, by an operation of a lever, between two connector housings.

2. Description of the Related Art

For example, in an electric vehicle or a hybrid vehicle, in order to secure operation safety such as for maintenance of an electric system, a power supply circuit breaker (service plug) capable of shutting off the conduction between a power supply and a load is installed. As a conventional power supply circuit breaker of this type, one disclosed in Patent Document 1 (US 2003/0057958 A) is given.

A conventional power supply circuit breaker 100 includes, as illustrated in FIGS. 1 to 3, a first connector housing 101, a second connector housing 110 configured to be mated with and separated from the first connector housing 101, and a lever 120 rotatably and slidably provided at the second connector housing 110 and configured to cause a mating force and a separating force to act between the second connector housing 110 and the first connector housing 101 by rotation of the lever 120.

A pair of cam pins 102 are protrudingly disposed on respective side faces of the first connector housing 101. The first connector housing 101 is provided with a first main terminal (not illustrated) and a first signal terminal (not illustrated) respectively. The first main terminal (not illustrated) is disposed in a connector mating chamber while the first signal terminal (not illustrated) is disposed in an outer hood portion 104.

A pair of support shafts 111 are protrudingly disposed on respective side faces of the second connector housing 110. The second connector housing 110 is provided with a second main terminal (not illustrated).

A pair of support shaft receiving grooves 121 are formed on respective side faces of the lever 120. Each of the support shaft receiving grooves 121 includes a rotation support portion 121*a* configured to support the rotation of concerned support shaft 111 and a slide support portion 121*b* which communicates with the rotation support portion 121*a* and is configured to support the sliding movement of the support shaft 111. Accordingly, the lever 120 is rotatably and slidably supported on the second connector housing 110. A pair of cam grooves 122 are provided on respective side faces of the lever 120. Each of the cam grooves 122 includes a curved portion 122*a* configured to gradually change the distance from concerned rotation support portion 121*a* and a straight portion 122*b* which communicates with the curved portion 122*a* and extends in parallel with the slide support portion 121*b*. The cam pins 102 of the first connector housing 101 are inserted into the cam grooves 122. A hood portion 124 for receiving the second signal terminal (not illustrated) is disposed at a side face portion of the lever 120.

A main circuit switch (not illustrated) includes the first main terminal (not illustrated) and the second main terminal (not illustrated). A signal circuit switch (not illustrated) includes the first signal terminal (not illustrated) and the second signal terminal (not illustrated).

In the above structure, the power supply conducting operation of the power supply circuit breaker 100 will be explained. As illustrated in FIG. 1, the second connector housing 110 with the lever 120 set in a first operation position is inserted into a connector mating chamber (not illustrated) of the first connector housing 101. Then, each of the cam pins 102 is inserted into an inlet of concerned cam groove 122 of the lever 120. The first connector housing 101 and the second connector housing 110 are brought into a connector temporary mating state.

Next, the lever 120 is rotated from the first operation position toward a second operation position. Then, the cam pins 102 move in the cam grooves 122 to thereby cause the mating force to act between the second connector housing 110 and the first connector housing 101. Accordingly, the second connector housing 110 will be gradually inserted into the connector mating chamber of the first connector housing 101.

Next, as illustrated in FIG. 2, the lever 120 is rotated to a connector mating operation position. Then, the first connector housing 101 and the second connector housing 110 are brought into a complete mating state. The first main terminal (not illustrated) and the second main terminal (not illustrated) gradually contact with each other in the process to the connector mating operation position, and then are brought into a contact state in the connector mating operation position. Accordingly, the main circuit switch (not illustrated) is brought into a connecting state in the connector mating operation position.

Next, the lever 120 is slidably moved from the connector mating operation position to the second operation position. In the slide movement process, the first signal terminal (not illustrated) and the second signal terminal (not illustrated) gradually contact with each other and then, as illustrated in FIG. 3, are brought into a contact state in the second operation position. Accordingly, the signal circuit switch (not illustrated) is brought into the connecting state in the second operation position of the lever 120.

The powersupply breaking operation of the power supply circuit breaker 100 is implemented by reversely operating the lever 120 as described above. That is, the lever 120 in the second operation position is slid to the connector mating operation position and is rotated from the connector mating operation position to the first operation position.

It is not until the main circuit switch (not illustrated) and the signal circuit switch (not illustrated) are both brought into the connecting state that the power supply circuit breaker 100 brings the power supply (not illustrated) into the conduction state. That is, only when the lever 120 is in the second operation position, the power supply is brought into the conduction state, and when the lever 120 is in the operation position(s) other than the second operation position, the power supply is in a non-conduction state.

This prevents such an event that the operator may misinterpret that the power supply is in the non-conduction state because the lever 120 is not in the second operation position.

Further, the lever 120 is slidably operated from the second operation position to the connector mating operation position and is rotatably operated from the connector mating operation position to the first operation position. Thus, a time lag can be secured in the operation from the second operation position to the first operation position of the lever 120, that is, a time lag can be secured from a breraking state of the signal circuit switch (not illustrated) to a breaking state of the man circuit switch (not illustrated). Thus, any failure such as spark which may be attributable to a remaining electric charge after the breaking of the signal circuit switch (not illustrated) can be prevented.

SUMMARY OF THE INVENTION

However, with the conventional power supply circuit breaker 100, since the lever 120 is not only rotated but also is slidably moved, the work space is enlarged by an amount equivalent to a sliding range S. In addition, there is a problem that the structure including metallic molds becomes complicated.

For solving the above problems, the present invention has been made. It is an object of the present invention to provide a power supply circuit breaker capable of minimizing a work space, simplifying the structure including metallic molds, and preventing failures attributable to remaining electric charge after breaking of a signal circuit switch.

A power supply circuit breaker according to a first aspect of the present invention includes: a first connector housing; a second connector housing capable of being mated with and separated from the first connector housing; a lever rotatably provided at the second connector housing, a main circuit switch, a signal circuit switch, a first lock portion, a second lock portion, an unlocking operation portion, and a rotation restricting portion. The lever causes a mating force and a separating force to act between the second connector housing and the first connector housing by a rotation between a first operation position and a connector mating operation position, and the lever is rotatable from the connector mating operation position to a second operation position. The main circuit switch includes: a first main terminal provided at the first connector housing, and a second main terminal provided at the second connector housing. The main circuit switch is brought into a breaking state with the first main terminal non-contacting the second main terminal in the first operation position of the lever, and the main circuit switch is brought into a connecting state with the first main terminal contacting the second main terminal in the connector mating operation position and second operation position of the lever. The signal circuit switch includes: a first signal terminal provided at the first connector housing, and a second signal terminal provided at the lever, the signal circuit switch is brought into a breaking state with the first signal terminal non-contacting the second signal terminal in the first operation position and connector mating operation position of the lever, and the signal circuit switch is brought into a connecting state with the first signal terminal contacting the second signal terminal in the second operation position of the lever. The first lock portion locks the lever in the second operation position. The second lock portion locks the lever in the connector mating operation position. The unlocking operation portion is capable of unlocking a lock state of the second lock portion. The rotation restricting portion is configured to restrict the rotation of the lever by abutting the unlocking operation portion in the second operation position when the unlocking operation portion is operated in a direction that is the same as a direction for unlocking the lock state of the second lock portion.

It is preferable that, in the second operation position of the lever, when the unlocking operation portion is operated in the direction that is the same as the direction for unlocking the lock state of the second lock portion, the rotation restricting portion prevents the unlocking operation portion from moving in the direction that is the same as the direction for unlocking the lock state of the second lock portion by abutting the unlocking operation portion and prevents the unlocking operation portion from making an excessive displacement, and in the connector mating operation position of the lever, the rotation restricting portion allows the unlocking operation portion to be moved to a position for unlocking the lock state of the second lock portion.

It is preferable that the unlocking operation portion includes: an elastic arm protruding from the second connector housing and a latching portion provided at the elastic arm; the second lock portion includes: the latching portion and a latched portion provided at the lever; and the rotation restricting portion is provided at a side opposite to the latched portion of the lever with the unlocking operation portion provided between the rotation restricting portion and the latched portion.

With the power supply circuit breaker according to the first aspect of the present invention, the rotating operation of the lever moves the lever from the first operation position to the second operation position via the connector mating operation position. Thus, without the need for the sliding of the lever as was conventionally seen, a smaller work space is accpetable, and further, without the need for the sliding mechanism of the lever, the structure including metallic molds can be simplified. Further, in the connector mating operation position of the lever after the lever is rotated from the second operation position to the connector mating operation position, the lever cannot rotate to the first operation position unless the second lock portion is shifted to the unlocking position by operating the unlocking operation portion. Thus, a time lag can be secured for the operation of the lever 30 from the second operation position to the first operation position. That is, the time lag can be secured from the breaking state of the signal circuit switch to the breaking state of the main circuit switch. This prevents failures such as spark which may be attributable to the remaining electric charge after breaking of the signal circuit switch.

Further, with the power supply circuit breaker, the rotation restricting portion allows that the locking of the first lock portion cannot be easily unlocked. Thus, it is possible to prevent the circuit switch of the power supply circuit breaker from being brought into the breaking state by an erroneous operation.

BRIEF DESCRIPTION OF THE DRAWINGS

FIG. 14 illustrates the power supply circuit breaker according to the embodiment, and is a table illustrating capability and incapability of unlocking a first lock portion LK1 and a second lock portion LK2 when the lever and the unlocking operation portion make a position change.

DESCRIPTION OF THE EMBODIMENTS

Figure 1:
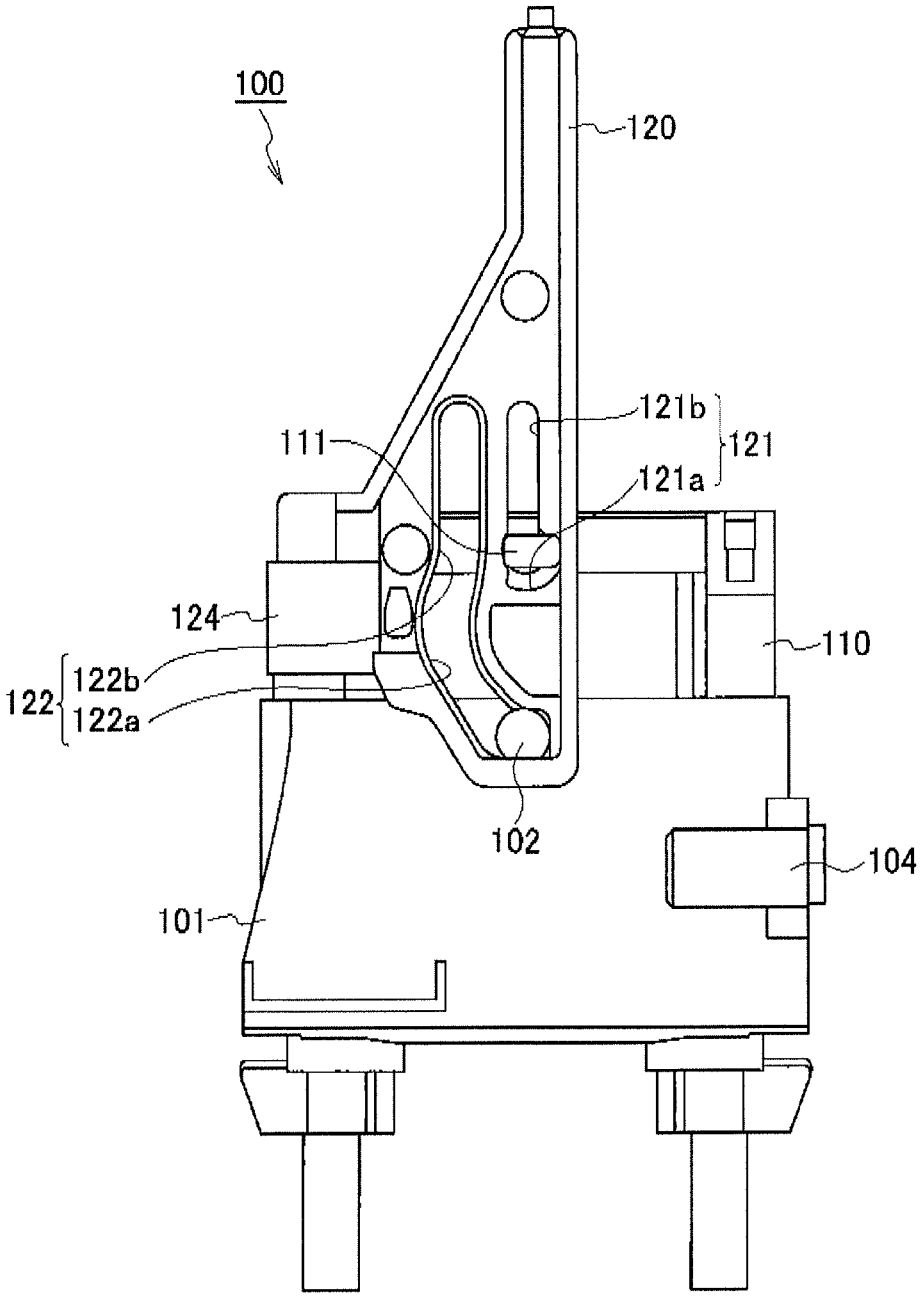
FIG.1 PRIOR ART
FIG. 1 illustrates a conventional power supply circuit breaker, and is a perspective view of a state in which a lever is positioned in a first operation position.
Figure 2:
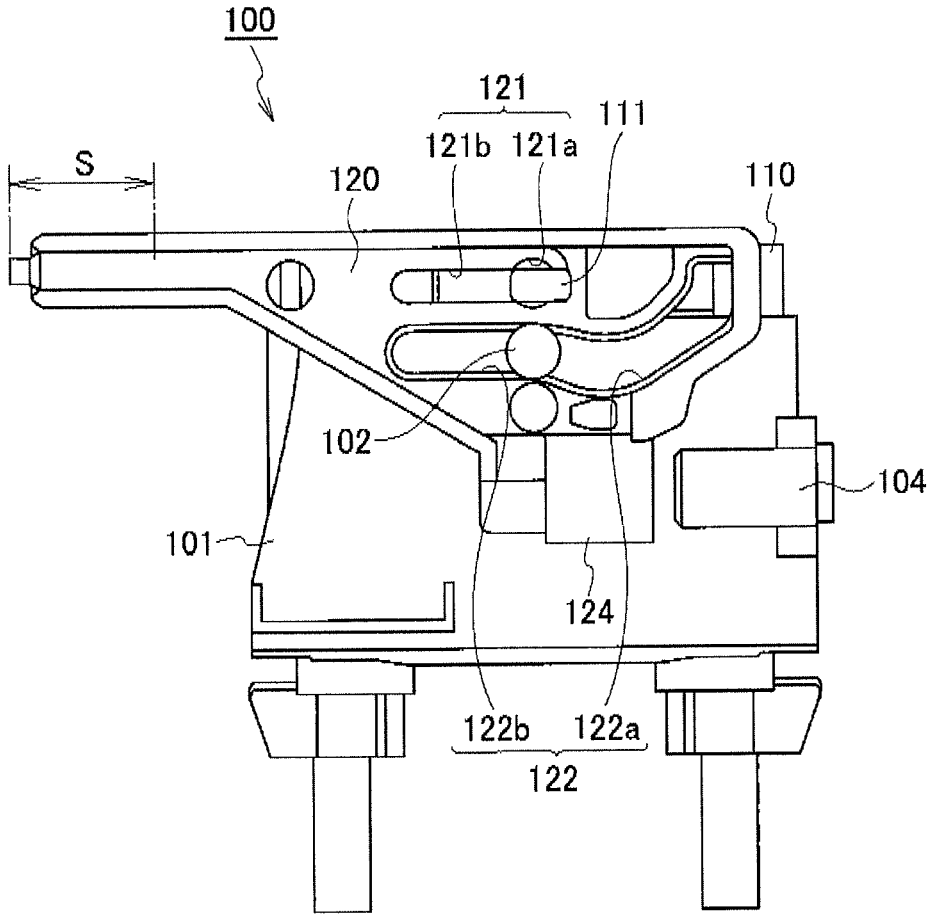
FIG.2 PRIOR ART
FIG. 2 illustrates the conventional power supply circuit breaker, and is a perspective view of a state in which the lever is positioned in a connector mating operation position.
Figure 3:
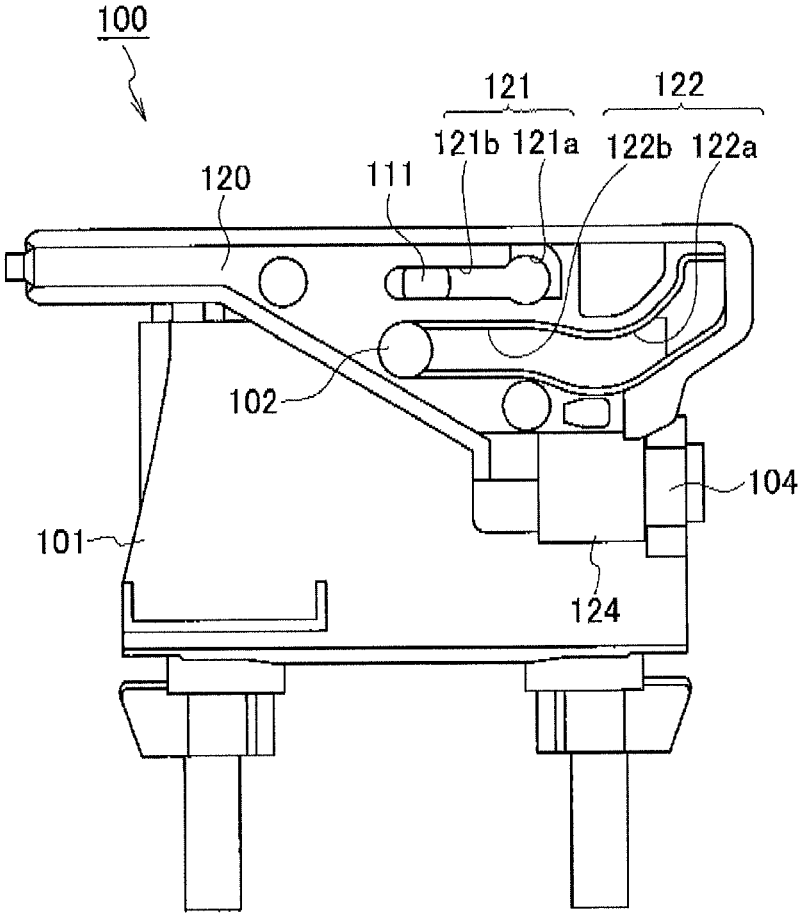
FIG.3 PRIOR ART
FIG. 3 illustrates the conventional power supply circuit breaker, and is a perspective view of a state in which the lever is positioned in a second operation position.

Hereinafter, an embodiment of the present invention will be explained based on the drawings.

As illustrated in FIGS. 4 to 15, a power supply circuit breaker 1A according to the embodiment includes a first connector housing 10, a second connector housing 20 configured to be mated with and separated from the first connector housing 10, and a lever 30 rotatably provided at the second connector housing 20 and adapted to cause a mating force and a separating force to act between the second connector housing 20 and the first connector housing 10 by rotation of the lever 30.

A pair of cam pins 11 are protrudingly provided on respective side faces of the first connector housing 10. The first connector housing 10 has a connector mating chamber 10*a* having an upper face opened. Two inner terminal hood portions 12 are provided in the connector mating chamber 10*a*. Each of first main terminals 13 is disposed in each of the inner terminal hood portions 12. Each of the first main terminals 13 is a female terminal.

The first connector housing 10 includes an outer terminal hood portion 15 provided outside the connector mating chamber 10*a*. The outer terminal hood portion 15 has an upper portion opened. Two first signal terminals 16 are disposed in the outer terminal hood portion 15. Details of the structure of the first signal terminals 16 will be described below.

A first latched portion 17 of a first lock portion LK1 is protrudingly provided on each side wall of the outer terminal hood portion 15. The first lock portion LK1 includes the first latched portions 17 and first latching portions 37 which will be described below, and locks the lever 30 at a second operation position. Each of the first latched portions 17 is capable of flexural deformation easily due to a slit 15*a* of a side wall of the outer terminal hood portion 15.

The second connector housing 20 includes a housing body 21 receiving therein a fuse 2, and a cover 22 fitted on an upper face of the housing body 21. The housing body 21 is formed to have such a dimension and a configuration that the housing body 21 can be mated with and separated from the connector mating chamber 10*a* of the first connector housing 10. At a lower part of the housing body 21, two second main terminals 23 are provided. Each of the second main terminals 23 is a male terminal. Each of the second main terminals 23 protrudes downward from the housing body 21. The two second main terminals 23 are connected with each other via the fuse 2. The two first main terminals 13 on the first connector housing 10 side and the two second main terminals 23 on the second connector housing 20 side constitute a part of a main circuit switch SW1.

On respective side faces of the housing body 21, a pair of rotation support shafts 24 are protrudingly provided. On respective side faces of the housing body 21, a pair of engagement protruding portions 25 are provided. Each of the engagement protruding portions 25 is in a form of a circular arc protrusion having a low height.

A second latching portion 26 of the second lock portion LK2 is protrudingly provided at the housing body 21. The second lock portion LK2 includes the second latching portion 26 and a second latched portion 41 which will be described below, and is adapted to lock the lever 30 in the connector mating operation position. The second latching portion 26 is provided at the unlocking operation portion 27. The unlocking operation portion 27 is capable of flexural deformation by a pressing force of a worker. On a rear side of each of the unlocking operation portion 27 and the second latching portion 26, an elastic deformation space 28 for accomplishing an elastic deformation is formed. Accordingly, when the unlocking preventing portion 38 is not positioned in the rear position as an unlocking position, pressing the unlocking operation portion 27 with a finger or the like of the worker can move the second latching portion 26 to the unlocking position.

Figure 8:
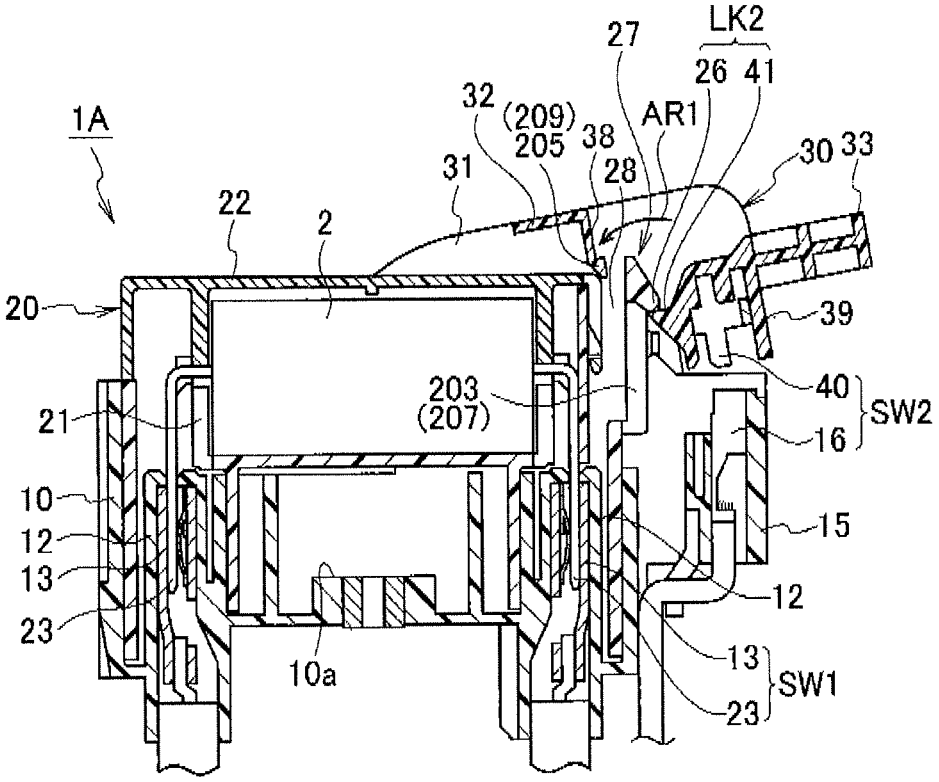
FIG. 8 illustrates the power supply circuit breaker according to the embodiment, and is a cross sectional view with the lever in the connector mating operation position and with the first connector housing and second connector housing in the complete mating state.

That is, pressing the unlocking operation portion 27 in the direction of an arrow AR1 in FIG. 8 to thereby elastically deform the unlocking operation portion 27 and then separating the second latching portion 26 from the second latched portion 41 can unlock the locking of the second lock portion LK2.

The lever 30 includes a pair of arm plate portions 31, and a connection portion 32 and a lever operation portion 33 for connecting the pair of arm plate portions 31 at respective rotation distal end sides. Each of the arm plate portions 31 is provided with one of a pair of rotation receiving portions 34. The pair of rotation support shafts 24 of the second connector housing 20 is pivotally supported on the pair of rotation receiving portions 34. Accordingly, the lever 30 is rotatably supported on the second connector housing 20. Each of the arm plate portions 31 is provided with one of a pair of cam grooves 35. The pair of cam pins 11 of the first connector housing 10 are inserted into the pair of cam grooves 35.

Figure 7:
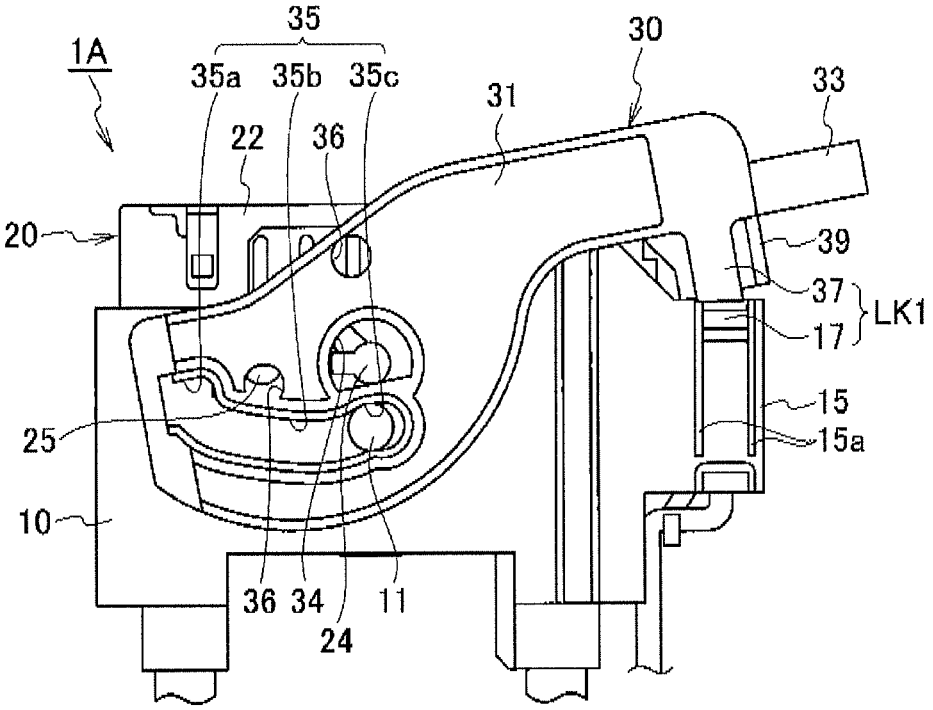
FIG. 7 illustrates the power supply circuit breaker according to the embodiment, and is a side view with the lever in a connector mating operation position and with the first connector housing and second connector housing in a complete mating state.
Figure 10:
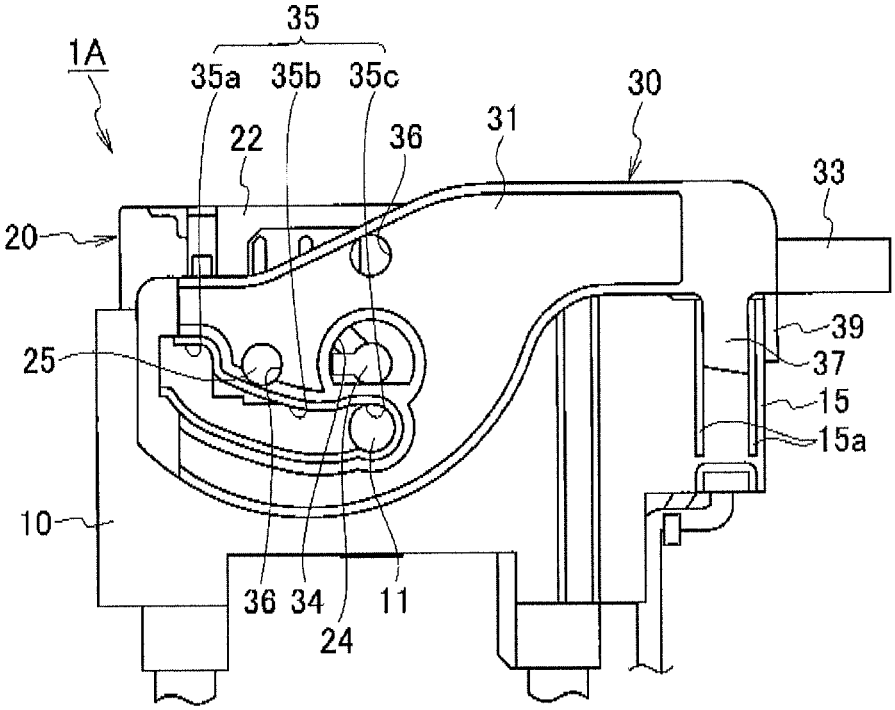
FIG. 10 illustrates the power supply circuit breaker according to the embodiment, and is a side view with the lever in the second operation position and with the first connector housing and second connector housing in the complete mating state.

As illustrated in FIGS. 7 and 10, each of the cam grooves 35 includes an entry straight portion 35*a* for allowing the cam pin 11 to enter, a curved portion 35*b* communicating with the entry straight portion 35*a* and configured to gradually change the distance from a center of the rotation receiving portion 34, and a circular arc portion 35*c* communicating with the curved portion 35*b* and having a constant distance from the center of the rotation receiving portion 34.

With the cam pins 11 moving in the cam grooves 35, the lever 30 rotates between the first operation position and the second operation position via the connector mating operation position. In the first operation position, each of the cam pins 11 is positioned at the entry straight portion 35*a*. In the connector mating operation position, each of the cam pins 11 is positioned on a boundary between the curved portion 35*b* and the circular arc portion 35*c*. In the second operation position, each of the cam pins 11 is positioned in the innermost position of the circular arc portion 35*c*.

That is, in the rotation process of the lever 30 between the first operation position and the connector mating operation position, each of the cam pins 11 moves in the curved portion 35*b*. In this case, a mating force or a separating force is caused to act between the first connector housing 10 and the second connector housing 20, to thereby move the first connector housing 10 and the second connector housing 20 in a mating direction or a separating direction. Further, in the rotation process of the lever 30 between the connector mating operation position and the second operation position, the cam pin 11 moves in the circular arc portion 35*c*, without causing the mating force or the separating force between the first connector housing 10 and the second connector housing 20, thus preventing the first connector housing 10 and the second connector housing 20 from moving in the mating direction or the separating direction.

Two position holding holes 36 are provided at each of the arm plate portions 31. In the first operation position or second operation position of the lever 30, each of the engagement protruding portions 25 is latched with one of the position holding holes 36. Thus, the lever 30 is positioned in the first operation position and the second operation position by a position holding force of one of the position holding holes 36.

Each of the first latching portions 37 of the first lock portion LK1 is provided at a rotation distal end side of each of the arm plate portions 31 and in a lower position of each of the arm plate portions 31. The pair of first latching portions 37 are formed such that they can be unlocked by a rotational force caused to act on the lever 30 by the worker. The connection portion 32 is provided with a plate-like unlocking preventing portion 38.

A hood portion 39 is provided below the lever operation portion 33. The hood portion 39 is open downward. In the hood portion 39, two second signal terminals 40 are disposed. The structure of the second signal terminals 40 will be described in detail later. The two first signal terminals 16 on the first connector housing 10 side and the two second signal terminals 40 on the lever 30 side constitute a part of the signal circuit switch SW2.

The lever operation portion 33 is provided with the second latched portion 41 of the second lock portion LK2.

Figure 11:
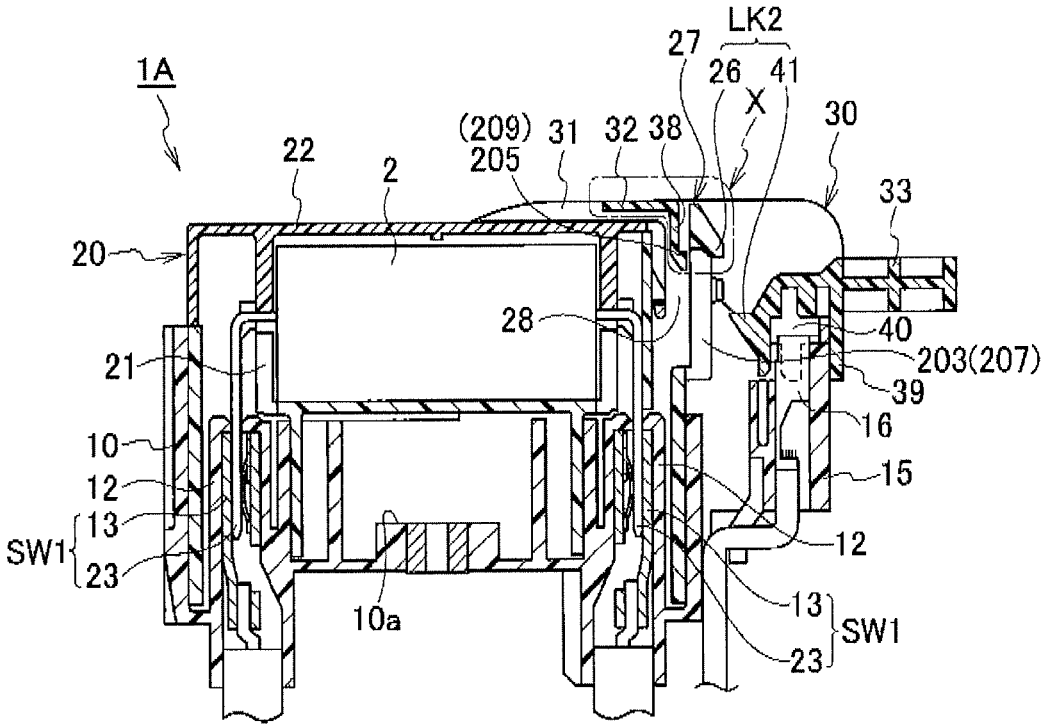
FIG. 11 illustrates the power supply circuit breaker according to the embodiment, and is a cross sectional view with the lever in the second operation position and with the first connector housing and second connector housing in the complete mating state.
Figure 12:
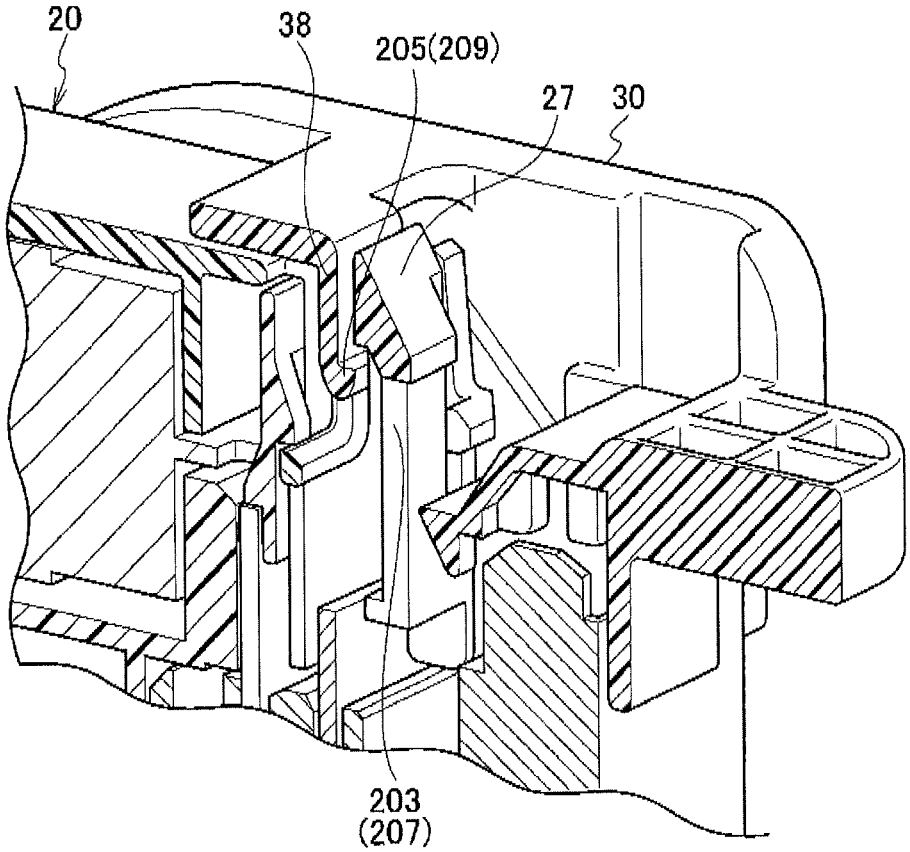
FIG. 12 illustrates the power supply circuit breaker according to the embodiment, and is a perspective cross sectional view illustrating a structure around a rotation restricting portion.

As illustrated in FIGS. 11 to 13, the power supply circuit breaker 1A is provided with a rotation restricting portion 205. It is so configured that, when the lever 30 is positioned in the second operation position, the unlocking operation portion 27 operated in a direction that is the same as the direction for unlocking the locking of the second lock portion LK2 allows the rotation restricting portion 205 to abut the unlocking operation portion 27, to thereby restrict the rotation of the lever 30. Accordingly, it is so configured that, when the lever 30 is positioned in the second operation position, the unlocking of the locking of the first lock portion LK1 is prevented.

Further, in the second operation position of the lever 30 (in the state in which the lever 30 is positioned in the second operation position), operating the unlocking operation portion 27 in the direction that is the same as the direction for unlocking the locking of the second lock portion LK2 allows the rotation restricting portion 205 to abut the unlocking operation portion 27, to thereby prevent the unlocking operation portion 27 from moving to the direction that is the same as the direction for the unlocking position (a position in which the locking of the second lock portion LK2 is unlockable).

Further, the rotation restricting portion 205 is provided with an excessive displacement preventing piece (unlocking preventing portion) 38 for preventing an excessive displacement of the unlocking operation portion 27. In the connector mating operation position of the lever 30, the rotation restricting portion 205 and the excessive displacement preventing piece 38 allow the unlocking operation portion 27 to move to the position in which the locking of the second lock portion LK2 can be unlocked.

The unlocking operation portion 27 includes an elastic arm 203 protruding from the second connector housing 20 and the second latching portion 26 provided at the elastic arm 203. The unlocking operation portion 27 is so configured as to be displaceable (elastically deformable) between an ordinary position causing no elastic deformation and a position in which the locking of the second lock portion LK2 can be unlocked.

The second lock portion LK2 includes the second latching portion 26 and the second latched portion 41 which is provided at the lever 30. The rotation restricting portion 205 is provided at a side opposite to the second latched portion 41 with the unlocking operation portion 27 provided between the rotation restricting portion 205 and the second latched portion 41.

The unlocking operation portion 27, the rotation restricting portion 205, and the like will be explained in more detail.

The unlocking operation portion 27 includes the elastic arm 203 which is a protrusion protruding from the housing body 21 of the second connector housing 20 and adapted to make an elastic deformation between the ordinary position (a position in which no external force is applied and no deformation is caused) and the deformation position (a position in which deformation is caused by a pressing force of a finger of the worker; a position in which an excessive displacement is caused). The elastic arm 203 is integrated with the housing body 21 of the second connector housing 20 and protrudes long from the housing body 21.

The second lock portion LK2 includes the second latching portion 26 provided at the unlocking operation portion 27 and the second latched portion 41 provided at the lever operation portion 33 of the lever 30.

The rotation restricting portion 205 and the unlocking preventing portion 38 are integrally provided with the connection portion 32 of the lever 30.

When the lever 30 is positioned in the second operation position and the first lock portion LK1 is in the lock state, the pressing force of the finger of the worker elastically deforms the unlocking operation portion 27 to the middle deformation position (refer to FIG. 13B) between the ordinary position and the deformation position. In this case, the elastic arm 203 and the rotation restricting portion 205 are caused to be engaged with each other (refer to FIG. 13B), to thereby prevent the first lock portion LK1 from moving to the unlocking position.

To explain further, the elastic arm 203 is formed with a through hole 207. The rotation restricting portion 205 includes a protruding portion 209 adapted to enter into the through hole 207. And the unlocking operation portion 27 (see FIG. 13A) in the ordinary position (no elastic deformation) is pressed with the finger of the worker in the direction of an arrow AR2 in FIG. 13A and thereby is elastically deformed and then reaches the middle deformation position (refer to FIG. 13B), and then the protruding portion 209 enters into the through hole 207. Then, the protruding portion 209 contacts an edge of the through hole 207, thus preventing the first lock portion LK1 from being unlocked (the lever 30 is unable to rotate in the direction of an arrow AR4 in FIG. 13B).

Figure 13A:
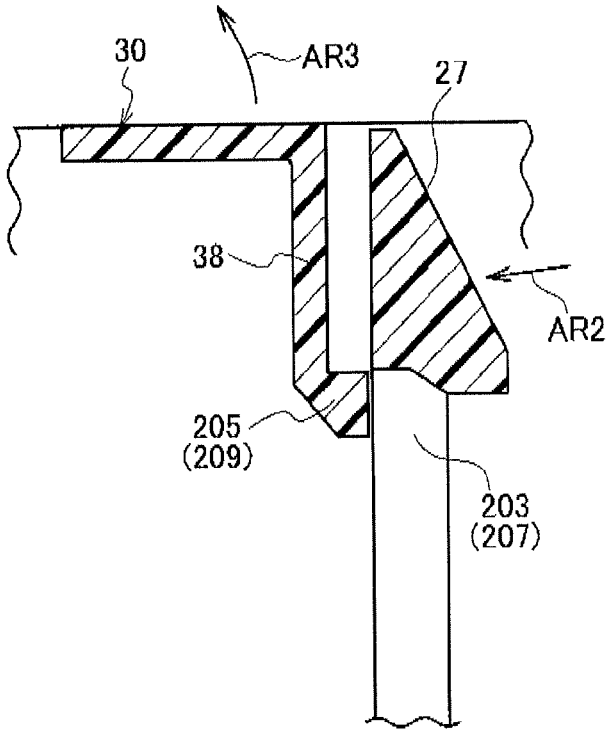
FIGS. 13A and 13B illustrate the power supply circuit breaker according to the embodiment, and are partial cross sectional views illustrating an unlocking operation portion and an excessive displacement preventing piece which are disposed at the rotation restricting portion.

In addition, in the ordinary position as illustrated in FIG. 13A, the lever 30 can rotate in the direction of an arrow AR3, thus making it possible to unlock the locking of the first lock portion LK1.

Figure 13B:
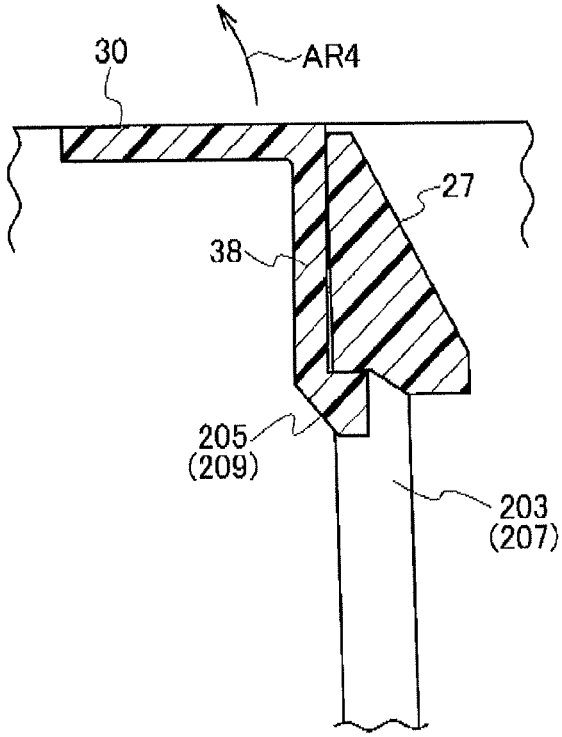

Further, when the unlocking operation portion 27 is positioned in the above-described deformation position, the unlocking operation portion 27 is positioned in a position where the unlocking operation portion 27 is deformed further leftward than in the position as illustrated in FIG. 13B. Thus, in order for the unlocking operation portion 27 to deform to the deformation position (a position in which the locking of the second lock portion LK2 can be unlocked), it is necessary that the lever 30 be positioned in the connector mating operation position as illustrated in FIG. 8 and thereby the unlocking preventing portion 38 be prevented from interfering with the unlocking operation portion 27.

Further, a holding portion (middle deformation position keeping portion) for holding the elastic deformation when the unlocking operation portion 27 is elastically deformed to the middle deformation position may be provided at the unlocking preventing portion 38.

Figure 15A:
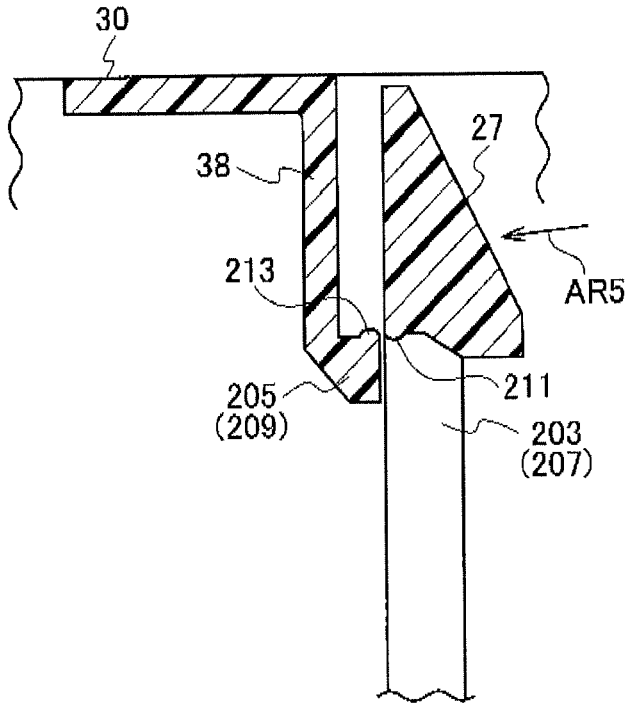
FIGS. 15A and 15B are modified examples of the rotation restricting portion corresponding to FIGS. 13A and 13B respectively.
Figure 15B:
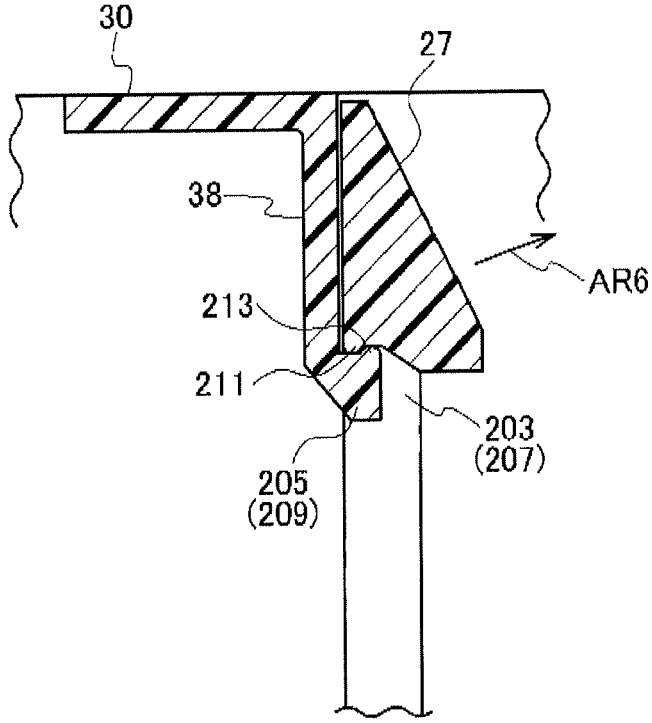

For example, as illustrated in FIG. 15A, a small convex portion 211 may be provided at the through hole 207 and a small convex portion 213 may be provided at the protruding portion 209 such that the convex portion 211 and the convex portion 213 are engaged with each other when the unlocking operation portion 27 is elastically deformed by being pressed in the direction of the arrow AR5 as illustrated in FIG. 15B so as to prevent the unlocking operation portion 27 from being easily restored in the direction of an arrow AR6 in FIG. 15B.

Next, a power supply system associated with the power supply circuit breaker 1A will be briefly explained. Between a power supply (not illustrated) and a load (not illustrated), the main circuit switch SW1 is connected in parallel with a relay (not illustrated) which is turned on and off by the signal circuit switch SW2. Thus, only when both of the main circuit switch SW1 and the signal circuit switch SW2 are brought into a connecting state, the power supply is brought into a connecting state. In any other switch state, the power supply is in a breaking state.

Figure 4:
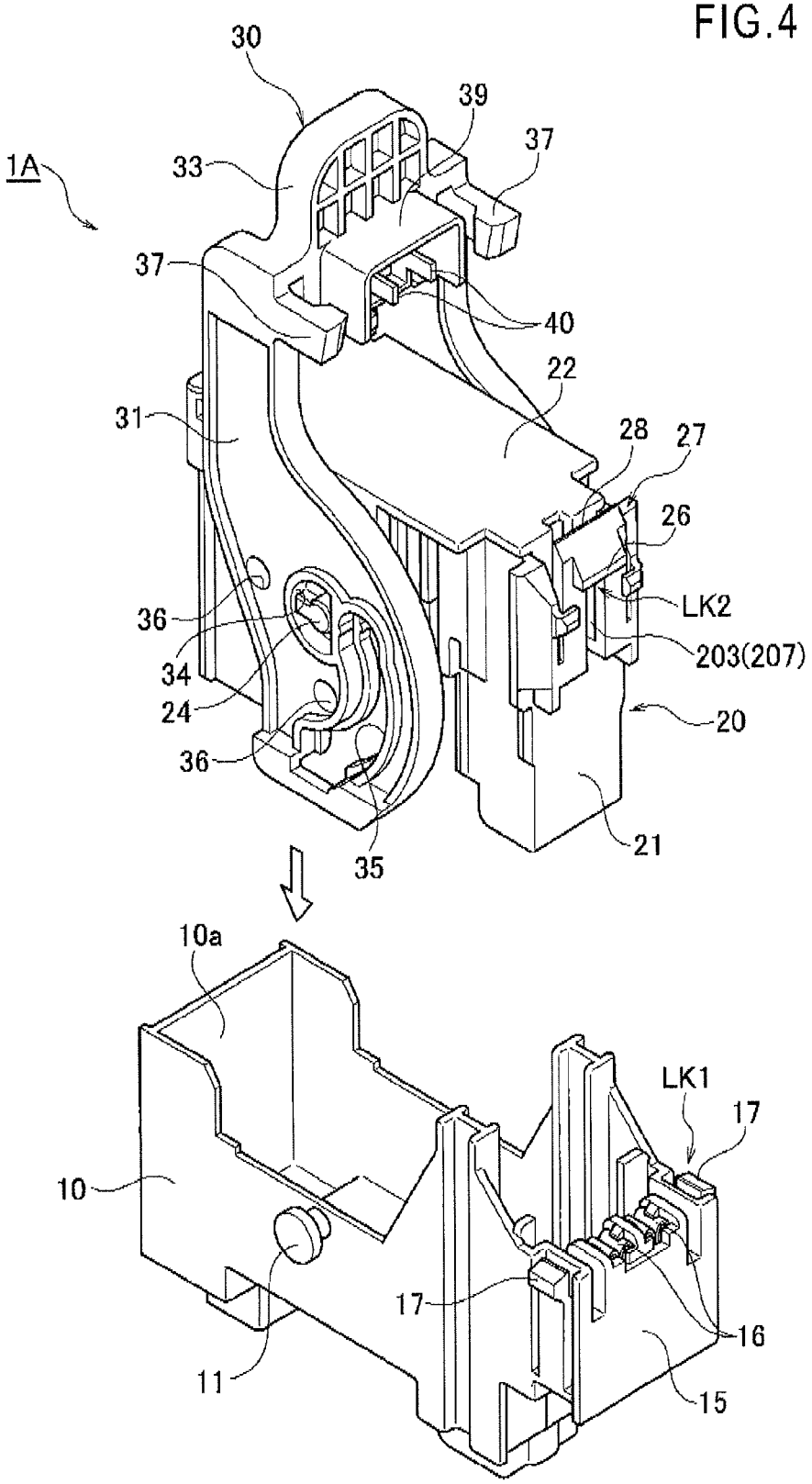
FIG. 4 illustrates a power supply circuit breaker according to one embodiment of the present invention, and is a perspective view with a first connector housing separated from a second connector housing.
Figure 5:
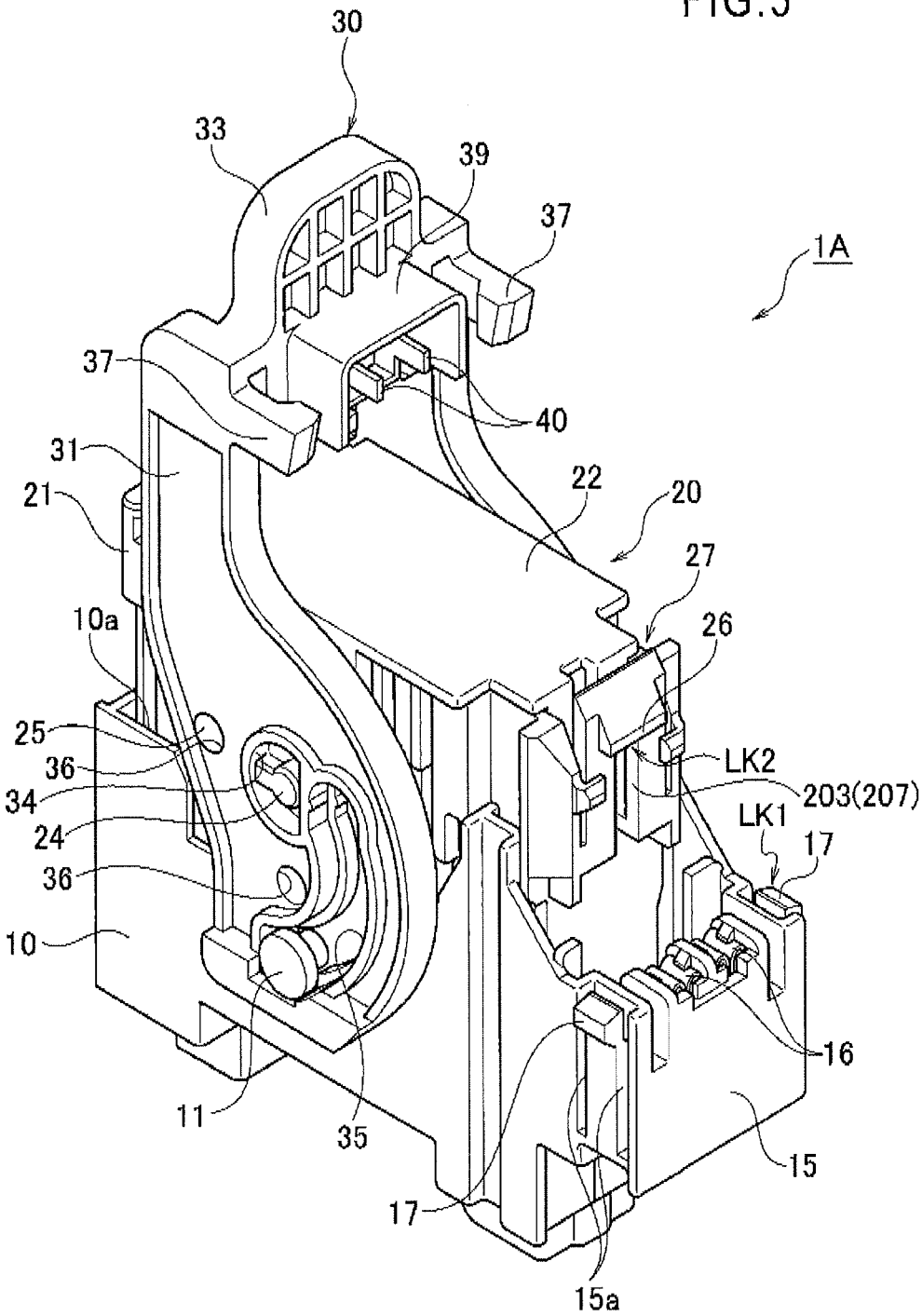
FIG. 5 illustrates the power supply circuit breaker according to the embodiment, and is a perspective view with a lever in a first operation position and with the first connector housing and second connector housing in a temporary mating state.
Figure 6:
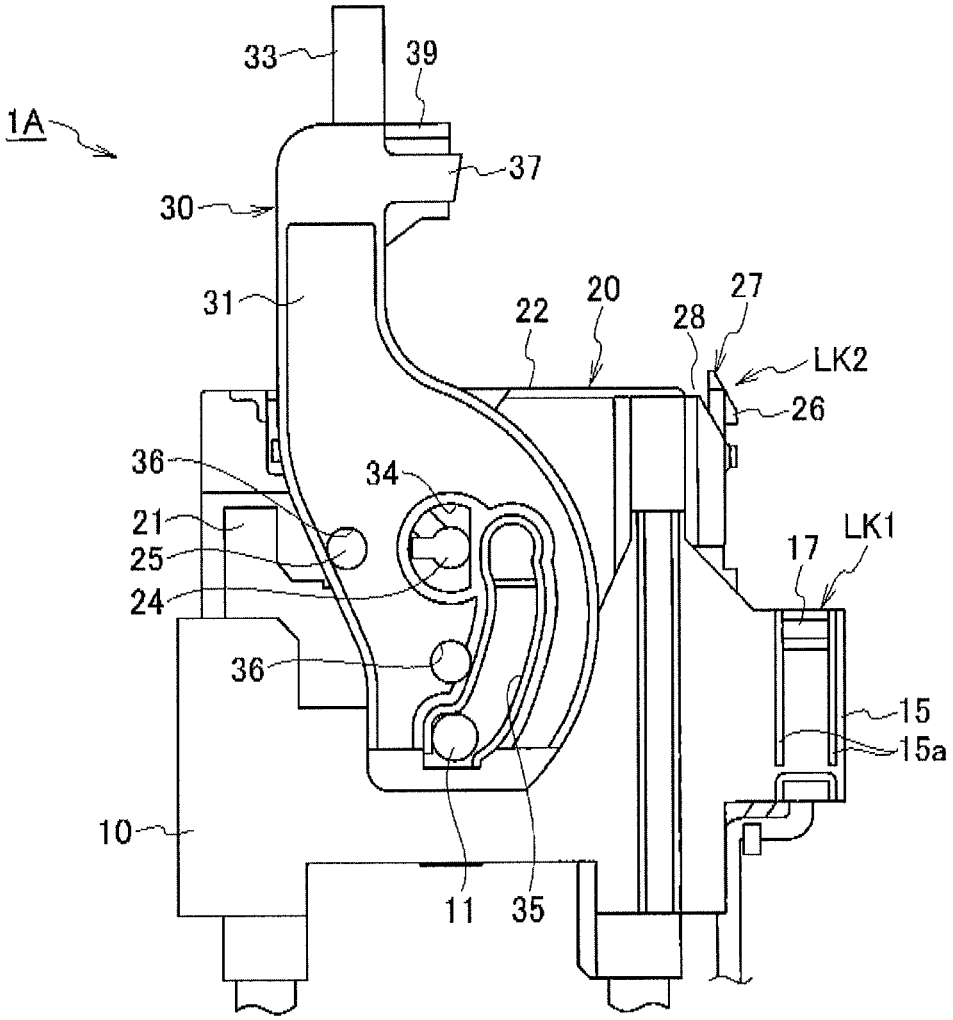
FIG. 6 illustrates the power supply circuit breaker according to the embodiment, and is a side view with the lever in the first operation position and with the first connector housing and second connector housing in the temporary mating state.

In the above structure, the conducting operation of the power supply by the power supply circuit breaker 1A will be explained. As illustrated in FIG. 4, the second connector housing 20 with the lever 30 set in the first operation position is aligned with the connector mating chamber 10*a* of the first connector housing 10. Then, as illustrated in FIGS. 5 and 6, the second connector housing 20 is inserted into the connector mating chamber 10*a* of the first connector housing 10 and the cam pin 11 is inserted into the entry straight portion 35*a* of the cam groove 35 of the lever 30. In this case, the first connector housing 10 and the second connector housing 20 are in the connector temporary mating state.

Next, the lever 30 is rotated from the first operation position toward the second operation position side. Then, the cam pin 11 moves in the cam groove 35, and the mating force is caused to act between the second connector housing 20 and the first connector housing 10, and the second connector housing 20 is gradually inserted into the connector mating chamber 10*a* of the first connector housing 10.

When the lever 30 is rotated to the connector mating operation position, as illustrated in FIGS. 7 and 8, the second latched portion 41 gets over the second latching portion 26 thereby allowing the second lock portion LK2 to be brought into the lock position, and the first connector housing 10 and the second connector housing 20 are brought into a complete mating state. In the process from the first operation position to the connector mating operation position, the first main terminals 13 and the second main terminals 23 start contacting with each other, and complete the contact in the connector mating operation position. In the connector mating operation position of the lever 30, the main circuit switch SW1 is in the connecting state.

Figure 9:
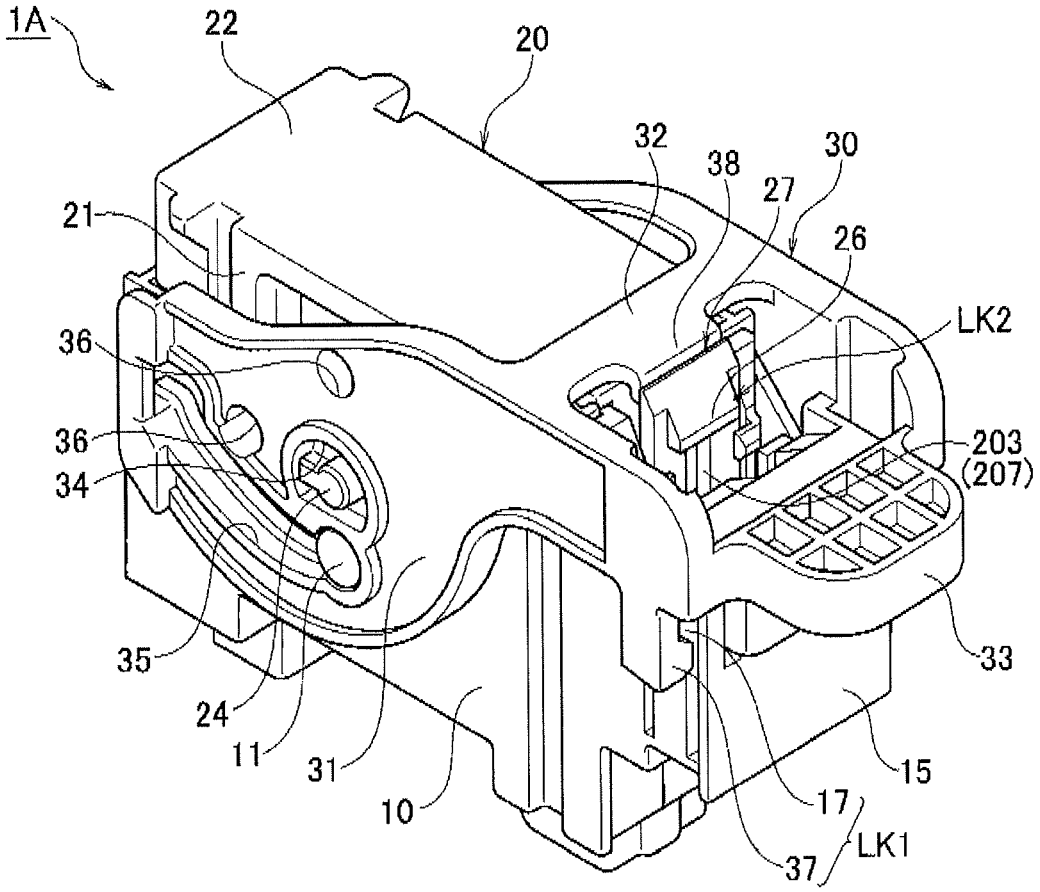
FIG. 9 illustrates the power supply circuit breaker according to the embodiment, and is a perspective view with the lever in a second operation position and with the first connector housing and second connector housing in the complete mating state.

When the lever 30 is rotated from the connector mating operation position to the second operation position, as illustrated in FIGS. 9 to 11, the unlocking preventing portion 38 enters into the elastic deformation space 28 and the first latching portion 37 gets over the first latched portion 17, to thereby allow the first lock portion LK1 to be positioned in the lock position. In the rotation process of the lever 30 from the connector mating operation position to the second operation position, the first signal terminals 16 and the second signal terminals 40 start contacting with each other, and complete the contact in the second operation position. In the second operation position of the lever 30, the signal circuit switch SW2 is brought into the connecting state. That is, the power supply is non-conductive in the connector mating operation position, and is brought into the conduction state only when the lever 30 reaches the second operation position.

Next, the power supply breaking operation by the power supply circuit breaker 1A will be explained. As illustrated in FIGS. 9 to 11, with the lever 30 in the second operation position, the lever 30 is rotated toward the first operation position side by a rotational force stronger than a locking force between the first latching portion 37 and the first latched portion 17. Then, the locking between the first latching portion 37 and the first latched portion 17 is unlocked to thereby allow the lever 30 to rotate. Accordingly, as illustrated in FIGS. 7 and 8, the lever 30 is rotated to the connector mating operation position. With the lever 30 rotated to the connector mating operation position, the second latched portion 41 of the lever 30 is latched with the second latching portion 26, thus bringing the second lock portion LK2 into the lock state. This once prevents the rotation of the lever 30. In the rotation process from the second operation position to the connector mating operation position of the lever 30, the first signal terminals 16 and the second signal terminals 40 gradually stop contacting with each other, and are brought into a complete non-contact state in the connector mating operation position of the lever 30. Thus, in the connector mating operation position of the lever 30, the signal circuit switch SW2 is brought into the breaking state. The power supply is non-conductive in the connector mating operation position.

Further, the rotation of the lever 30 from the second operation position to the connector mating operation position allows the unlocking preventing portion 38 of the lever 30 to be pulled out from the elastic deformation space 28 of the first connector housing 10.

Next, the unlocking operation portion 27 is caused to elastically deform by utilizing the elastic deformation space 28, the second latching portion 26 of the second lock portion LK2 is shifted to the unlocking position, to thereby unlock the second latching portion 26 from the second latched portion 41. This allows the rotation of the lever 30 to the first operation position side, thus rotating the lever 30 to the first operation position. In the rotation of the lever 30 from the connector mating position to the first operation position, the cam grooves 35 and the cam pins 11 cause the separating force to act between the second connector housing 20 and the first connector housing 10, thus gradually pulling out the second connector housing 20 from the connector mating chamber 10*a* of the first connector housing 10.

As illustrated in FIGS. 5 and 6, in the first operation position of the lever 30, the first connector housing 10 and the second connector housing 20 are in the temporary mating state. The first main terminals 13 and the second main terminals 23 gradually stop contacting with each other in the process from the connector mating operation position to the first operation position, and then are brought into a complete non-conductive state in the first operation position. Thus, the main circuit switch SW1 is brought into the breaking state in the first operation position of the lever 30.

Here, the operation of the rotation restricting portion 205 and the like in the power supply circuit breaker 1A will be explained.

First, it is assumed that, as illustrated in FIGS. 11, 13A, and 12, the lever 30 is in the second operation position and the unlocking operation portion 27 is in the ordinary position. In this state, the unlocking operation portion 27 is pressed in the direction of the arrow AR2 illustrated in FIG. 13A. Then, as illustrated in FIG. 13B, the unlocking operation portion 27 causes an elastic deformation, abuts the unlocking preventing portion (excessive displacement preventing piece) 38, and is positioned in the middle deformation position.

When the unlocking operation portion 27 is positioned in the middle deformation position, the elastic arm 203 is engaged with the rotation restricting portion 205, thus preventing the lever 30 from rotating in the direction of the arrow AR4. Thus, it is not possible to unlock the locking of the first lock portion LK1.

For unlocking the locking of the first lock portion LK1, the unlocking operation portion 27 is restored as illustrated in FIG. 13A.

Here, possibility and the like of unlocking the first lock portion LK1 and second lock portion LK2 with respect to the combination of the position of the lever 30 and the position of the unlocking operation portion 27 are illustrated in FIG. 14.

As explained above, the power supply circuit breaker 1A includes the first connector housing 10, the second connector housing 20, the lever 30 which is rotatably provided at the second connector housing 20, the main circuit switch SW1, the signal circuit switch SW2, the first lock portion LK1, the second lock portion LK2, and the unlocking operation portion 27. The main circuit switch SW1 includes the first main terminals 13 provided at the first connector housing 10 and the second main terminals 23 provided at the second connector housing 20. The main circuit switch SW1 is brought into the breaking state with the first main terminals 13 non-contacting the second main terminals 23 in the first operation position of the lever 30. The main circuit switch SW1 is brought into the connecting state with the first main terminal 13*s* contacting the second main terminals 23 in the connector mating operation position and second operation position of the lever 30. The signal circuit switch SW2 includes the first signal terminals 16 provided at the first connector housing 10 and the second signal terminals 40 provided at the lever 30. The signal circuit switch SW2 is brought into the breaking state with the first signal terminals 16 non-contacting the second signal terminals 40 in the first operation position and connector mating operation position of the lever 30. The signal circuit switch SW2 is brought into the connecting state with the first signal terminals 16 contacting the second signal terminals 40 in the second operation position of the lever 30. The LK1 locks the lever 30 in the second operation position. The second lock portion LK2 locks the lever 30 in the connector mating operation position. Operating the unlocking operation portion 27 can unlock the lock state of the second lock portion LK2.

Only the rotating operation of the lever 30 moves the lever 30 from the first operation position to the second operation position via the connector mating operation position. Thus, the work space can be minimized as much as a portion equivalent to the sliding of the lever as was conventionally necessary. Further, the structure including metallic molds can be simplified by a portion equivalent to a sliding mechanism of the lever 30 which becomes unnecessary. Further, in the connector mating operation position of the lever 30, the lever 30 cannot rotate to the first operation position unless the second lock portion LK2 is shifted to the unlocking position by the operation of the unlocking operation portion 27. Thus, a time lag can be secured for operating the lever 30 from the second operation position to the first operation position. That is, the time lag can be secured from the breaking state of the signal circuit switch SW2 to the breaking state of the main circuit switch SW1. This prevents failures such as a spark which may be attributable to the remaining electric charge of the power supply after breaking of the signal circuit switch SW2.

The power supply circuit breaker 1A includes the unlocking preventing portion 38. In the second operation position of the lever 30, the unlocking preventing portion 38 prevents the second lock portion LK2 from moving to the unlocking position. While in the connector mating operation portion of the lever 30, the unlocking preventing portion 38 allows the second lock portion LK2 to move to the unlocking position. Therefore, the second latching portion 26 cannot be moved to the unlocking position until the rotation of the lever 30 from the second operation position to the connector mating operation position is completed. Thus, in the connector mating operation position of the lever 30, an operation is provided for moving the second latching portion 26 of the second lock portion LK2 to the unlocking position. Thus, the time lag can be reliably ensured in operating the lever 30 from the second operation position to the first operation position. That is, the time lag can be reliably ensured from the breaking state of the signal circuit switch SW2 to the breaking state of the main circuit switch SW1. This assuredly prevents failures such as a spark which may be attributable to the remaining electric charge of the power supply after breaking of the signal circuit switch SW2.

The lever 30 has such a structure that the lever 30 rotated between the first operation position and the connector mating operation position causes the mating force or separating force to act between the second connector housing 20 and the first connector housing 10 and that the lever 30 rotated between the connector mating operation position and the second operation position does not cause the mating force and the separating force to act between the first connector housing 10 and the second connector housing 20. Therefore, the cam grooves 35 are so set that, in the rotation process of the lever 30 from the second operation position to the connector mating operation position, only the signal circuit switch SW2 is brought into the breaking state with no relative movement between the first main terminals 13 and the second main terminals 23. Then, after the power supply is brought into the breaking state, the relative movement between the first main terminals 13 and second main terminals 23 of the main circuit switch SW1 is accomplished only thereafter in the rotation process of the lever 30 from the connector mating operation position to the first operation position. Accordingly, the failures which may be attributable to the relative movement between the first main terminals 13 and second main terminals 23 of the main circuit switch SW1 when both the main circuit switch SW1 and the signal circuit switch SW2 are in the connecting state, that is, when the power supply is conductive can prevented.

The first lock portion LK1 can be unlocked by the rotational force caused to act on the lever 30 by the worker and the second lock portion LK2 can be unlocked by the pressing force of the worker. Accordingly, the worker can implement operations of the lever 30 from the first operation position to the second operation position, without using a tool, jig, or the like.

Further, with the power supply circuit breaker 1A, the rotation restricting portion 205 makes it such that the locking of the first lock portion LK1 cannot be easily unlocked. Thus, it is possible to prevent such an event that the main circuit switch SW1 and signal circuit switch SW2 of the power supply circuit breaker 1A may be brought into the breaking state by an erroneous operation.

Further, with the power supply circuit breaker 1A, providing the rotation restricting portion 205 can prevent the first lock portion LK1 from moving to the unlocking position by an operation of the unlocking operation portion 27 to unlock the lock state of the second lock portion LK2. That is, even when such an erroneous operation is attempted to unlock the second lock portion LK2 before the unlocking of the first lock portion LK1, not only the second lock portion LK2 cannot be unlocked but also the first lock portion LK1 cannot be unlocked. Thus, bringing the main circuit switch SW1 and signal circuit switch SW2 of the power supply circuit breaker 1A into the breaking state by the erroneous operation can be further reliably prevented.

What is claimed is:

1. A power supply circuit breaker, comprising:

a first connector housing;

a second connector housing capable of being mated with and separated from the first connector housing;

a lever rotatably provided at the second connector housing, the lever being adapted to cause a mating force and a separating force to act between the second connector housing and the first connector housing by a rotation between a first operation position and a connector mating operation position, the lever being further rotatable from the connector mating operation position to a second operation position;

a main circuit switch including a first main terminal provided at the first connector housing and a second main terminal provided at the second connector housing, the main circuit switch being adapted to be brought into a breaking state with the first main terminal non-contacting the second main terminal in the first operation position of the lever, and the main circuit switch being adapted to be brought into a connecting state with the first main terminal contacting the second main terminal in the connector mating operation position and the second operation position of the lever;

a signal circuit switch including a first signal terminal provided at the first connector housing; and a second signal terminal provided at the lever, the signal circuit switch being adapted to be brought into a breaking state with the first signal terminal non-contacting the second signal terminal in the first operation position and the connector mating operation position of the lever, and the signal circuit switch being adapted to be brought into a connecting state with the first signal terminal contacting the second signal terminal in the second operation position of the lever;

a first lock portion for locking the lever in the second operation position;

a second lock portion for locking the lever in the connector mating operation position; an unlocking operation portion capable of unlocking a lock state of the second lock portion; and a rotation restricting portion configured to restrict the rotation of the lever by abutting the unlocking operation portion in the second operation position when the unlocking operation portion is operated in a direction that is the same as a direction for unlocking the lock state of the second lock portion;

wherein the lever is configured to rotate but not configured to slide relative to either of the first connector housing or the second connector housing.

2. The power supply circuit breaker according to claim 1, wherein in the second operation position of the lever, when the unlocking operation portion is operated in the direction that is the same as the direction for unlocking the lock state of the second lock portion, the rotation restricting portion prevents the unlocking operation portion from moving in the direction that is the same as the direction for unlocking the lock state of the second lock portion by abutting the unlocking operation portion and prevents the unlocking operation portion from making an excessive displacement, and in the connector mating operation position of the lever, the rotation restricting portion allows the unlocking operation portion to be moved to a position for unlocking the lock state of the second lock portion.

3. The power supply circuit breaker according to claim 2, wherein the unlocking operation portion comprises an elastic arm protruding from the second connector housing, and a latching portion provided at the elastic arm, the second lock portion comprises the latching portion, and a latched portion provided at the lever, and the rotation restricting portion is provided at a side opposite to the latched portion of the lever with the unlocking operation portion provided between the rotation restricting portion and the latched portion.

* * * * *